US005331895A

United States Patent [19]

Bourne et al.

[11] Patent Number: 5,331,895

[45] Date of Patent: Jul. 26, 1994

[54] SHAPED CHARGES AND THEIR MANUFACTURE

[75] Inventors: Brian Bourne; Peter N. Jones, both of Sevenoaks; Roger H. Warren, Wrothan, all of England

[73] Assignee: The Secretary of State for Defence in Her Britanic Majesty's Government of the United Kingdon of Great Britain and Northern Ireland, London, England

[21] Appl. No.: 595,672

[22] Filed: Oct. 11, 1990

Related U.S. Application Data

[63] Continuation of Ser. No. 314,698, Feb. 10, 1989, abandoned.

[30] Foreign Application Priority Data

Jul. 22, 1982 [GB] United Kingdom ..... 8220767

[51] Int. Cl.[5] ..... F42B 1/02

[52] U.S. Cl. ..... 102/307; 102/310; 102/476

[58] Field of Search ..... 102/307, 310, 476

[56] References Cited

U.S. PATENT DOCUMENTS

| | | | |
|---|---|---|---|
| 3,136,249 | 6/1964 | Poulter | 102/307 X |
| 3,255,659 | 6/1977 | Venghiattis | 102/307 X |
| 3,375,108 | 3/1968 | Wyman, Sr. et al. | 102/306 X |
| 4,441,428 | 4/1984 | Wilson | 102/306 X |
| 4,551,287 | 11/1985 | Bethmann | 102/307 X |
| 4,598,643 | 7/1986 | Skrocki | 102/307 |
| 4,613,370 | 9/1986 | Held et al. | 102/306 X |
| 4,867,061 | 9/1989 | Stadler et al. | 102/307 |
| 4,875,414 | 10/1989 | Stadler et al. | 102/307 |
| 4,896,332 | 1/1990 | Wisotzki | 102/307 X |

FOREIGN PATENT DOCUMENTS

| | | | |
|---|---|---|---|
| 2530800 | 6/1980 | France | 102/306 |

OTHER PUBLICATIONS

Sintering Processes, edited by G. C. Kucznski, Material Science Research, vol. 13, published by Plenum Press, 1979.

Page 403 of "An Introduction to Metallurgy" by Alan Cottrell, published by Edward Arnold.

Page 219 of "Direct Observation of Densification and Grain Growth in a W-Ni Alloy" by H. Riegger et al.

Page 189 of "The Elementary Mechanism of Liquid Phase Sintering".

*Primary Examiner*—Peter A. Nelson

*Attorney, Agent, or Firm*—Cushman, Darby & Cushman

[57] ABSTRACT

A shaped charge liner formed of a solid metallic material having a fine grain size of the order of 25 microns or less. The material can be, for example, copper, uranium, tantalum or an alloy showing superplasticity and having a density greater than about 5 gm/cm$^3$. The liner can be made by subjecting the material to repeated cycles of cold working, annealing at just above the recrystallization temperature, and quenching.

9 Claims, 3 Drawing Sheets x400 x400 x400 x400 x400 x400

SHAPED CHARGES AND THEIR MANUFACTURE

This is a continuation of application Ser. No. 07/314,698, filed on Feb. 10, 1989, which was abandoned.

BACKGROUND OF THE INVENTION

This invention concerns shaped charges, that is explosive devices of the kind comprising a mass of explosive having a shaped hollow formed in an end face, the hollow being lined with a metallic material. The metallic material is usually copper, but can be of other suitable metals or alloys which may or may not include copper. The shaped hollow is often of conical form, but other shapes can be used such as hemispheres, trumpet-shapes, or shapes comprising sections of two or more cones having different apex angles. Shaped charges in which the shaped hollow does not possess rotational symmetry are also within the scope of the invention—for example those having a hollow in the form of an annular or linear trough.

As is well known, the shaped charge is capable, by appropriate design, of producing a jet having enormous powers of penetration. However, the present state of development of armour for battle tanks is such that the best modern tanks can in practice be provided with armour just capable of defeating most shaped charge weapons. Any small improvement in the performance of the shaped charge is thus likely to be of decisive importance in an attack on a modern armoured fighting vehicle. Clearly also, in other fields, an improved penetrative performance is highly desirable.

Factors known to affect the performance of a shaped charge include careful control of the shape and dimensional tolerances of the liner, the explosive properties and the uniformity of the explosive material, and the design and proper functioning of the initiation devices. At the present time it is considered that these three factors have been largely optimised, and further substantial improvements in them is not foreseen at present.

A fourth major factor affecting performance is the composition of the liner material, and the present invention provides for a substantial improvement in this factor.

SUMMARY OF THE INVENTION

Accordingly, the present invention provides a liner for a shaped charge comprising a solid metallic material having a fine grain size of the order of 25 microns or less.

The term "solid" as used herein is intended to convey the meaning of a substantially non-porous or void-free material, in contrast for example to a porous material formed by sintering or adhesively bonding particulate material.

Normally the advantages of the invention will be secured only with a grain size of 22 microns or less and usually, for best results combined with relative ease of manufacture, the grain size will be in the range of 10–15 microns, although it is believed that the benefit of the invention will be obtained will even smaller grain sizes.

Potentially suitable materials for the liner include copper, uranium, tantalum and alloys which exhibit superplasticity and have densities greater than about 5 gm/cm$^3$. For example, superplastic alloys based on bismuth, cadmium, iridium, lead, tin, zinc, aluminium, silver, copper, iron, nickel, titanium, cobalt, chromium, tungsten and uranium.

Copper is currently preferred, however. For unspun rounds it is preferred that the metallic material of the liner should be highly isotropic.

The metallic material may include elemental additions which serve to refine the grain size, for example the material may be a Copper-1% Chromium alloy or a Uranium-5% Molybdenum alloy.

The invention also includes within its scope a shaped charge comprising a liner in accordance with the invention and an explosive mass associated with the liner.

In the past it has been recognized that a very coarse grain structure in which the grain size is of the order of 100 microns or more, perhaps approximating to the wall thickness of the liner itself, is undesirable. However, in normal practice a grain size of about 50 microns perhaps down to 30 microns has been achieved without any very special treatment. Liners having such a metallographic structure have been considered to give a satisfactory performance, and no reason has been seen why it should be worthwhile to seek a finer structure than this. Hence it has never been proposed to provide a shaped charge liner having an exceptionally fine grain structure in accordance with the invention. Conventional techniques for forming shaped charge liners inherently lead to a high degree of anisotropy, but here again the importance of this factor has not been fully appreciated in the past.

A shaped charge liner comprising very small spherical particles which are bonded together by sintering, welding, adhesive bonding or similar techniques without loss of spherical form, is described in UK Patent No 854043. The resultant liner material is porous, and will particulate on firing so that its performance will be considerably degraded as compared to a solid liner. Also, although the particles are described as being of very small size, e.g. down to 5 microns, they are spherical in form, and the crystal grain form in a solid liner will differ from that of such a particulate liner in important respects affecting penetrating performance both because of the voids present and because of the essentially particulate nature and different crystal grain form of the latter.

Tests have shown that shaped charges having limits in accordance with the invention are capable of 10 to 15% greater penetration into rolled homogeneous armour (RHA) as compared with shaped charges having conventional liners.

The formation of a shaped charge liner having a fine equi-axed, grain structure and isotropic properties, particularly in copper, is a difficult matter, and this may at least in part explain the failure in the art to have arrived earlier at the present invention, and to have appreciated its advantages.

Accordingly the invention provides in another aspect a method of fabricating a shaped charge liner from a metallic material, comprising the repeated application to the material of a process comprising the steps of cold working the material, determining the recrystallization temperature of the cold worked material, annealing the cold worked material at a temperature just in excess of the recrystallization temperature, and quenching the annealed material.

Suitably at least one cold working step involves a substantial reduction in thickness of the material, of at least 50%.

The upper limit of cold working would be determined by the avoidance of cracking, and 80% would be a reasonable upper limit for many ductile materials such as copper.

The recrystallization temperature is conveniently determined after each cold working step by preparing a plurality of samples from the cold worked material, annealing different samples at different temperatures, quenching each sample, and performing metallographic examination of each sample.

By recrystallization temperature is meant the lowest temperature at which the deformed structure can be completely replaced by a new set of equi-axed grains, in an appropriate length of time.

The annealing step is preferably carried out at each stage for a period just sufficient to ensure substantially complete recrystallization of the cold-worked material. The annealing temperature at each stage is preferably within 20° C. above the recrystallization temperature.

Suitably each annealing step takes place at a temperature in the range 5°-15° C., preferably about 10° C. above the recrystallization temperature, for a period of about one hour.

Quenching may be carried out in water.

The metallic material is advantageously copper.

The method may further comprise a machining step after the final application of the said process.

BRIEF DESCRIPTION OF THE DRAWINGS

The invention will now be further described by way of example only, and with reference to the accompanying drawings, of which

DETAILED DESCRIPTION OF THE PREFERRED EMBODIMENTS

Figure 1:
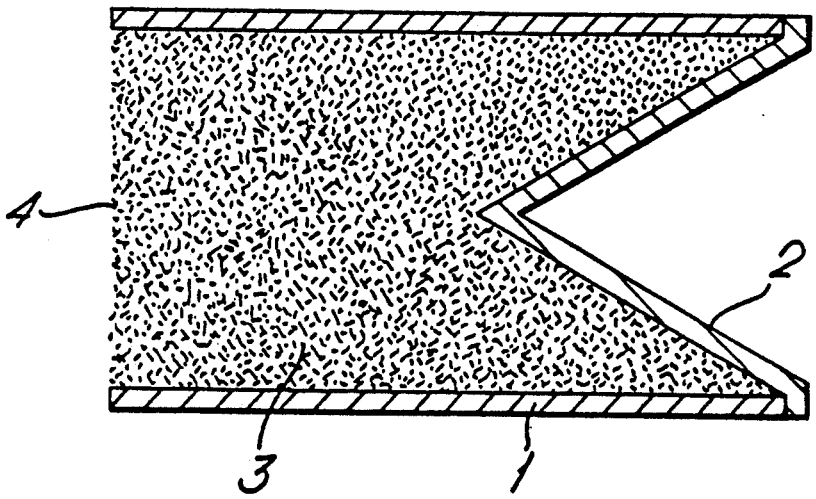
FIG. 1 shows diagrammatically a shaped charge having a solid liner in accordance with the invention.

As shown in FIG. 1, a shaped charge of generally conventional configuration comprises a light cylindrical casing 1 of plastics or metallic material and a copper liner 2 of conical form and typically of say 2 mm wall thickness. The liner 2 fits closely in one end of the cylindrical casing 1, and within the volume defined by the casing and within the liner there is cast a body 3 of a high explosive material. In practice a detonating device (not shown) would be positioned on the rear end surface 4 of the cast body 3.

The process for the fabrication of the conical liner 2 in accordance with the invention is suitably as follows. A suitable starting material is a billet 63.5 mm±0.5 mm thick, of copper to BS2874 C103 condition H, i.e. Oxygen-Free high conductivity copper 99.95% Copper (including silver), 0.005% max lead, 0.0010% max bismuth, total impurities 0.03% max (excluding oxygen and silver).

Figure 2:
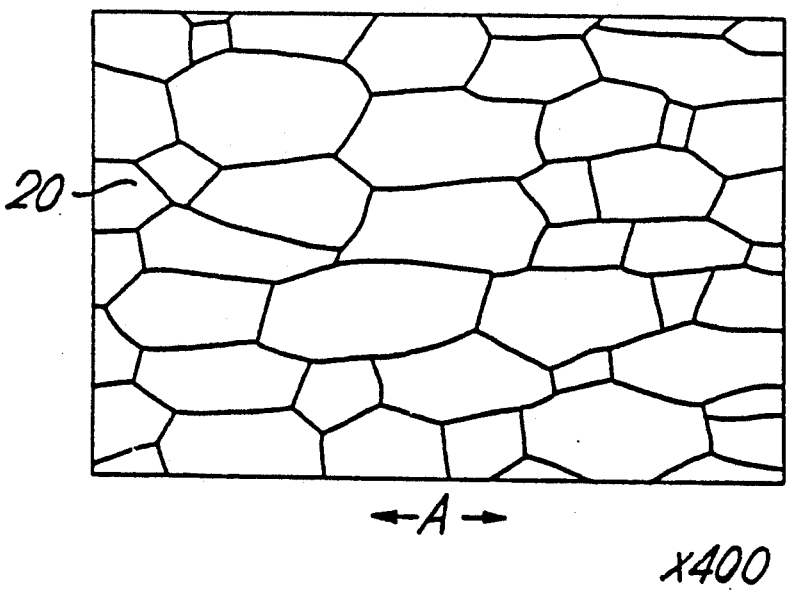
FIGS. 2-4*a* thru *c* are diagrammatic representations derived from photo-micrographs showing the micro structure of specimens taken from the liner material at various stages in the manufacture of the liner.

The micro structure of the starting material is illustrated in FIG. 2 which is derived from the photomicrograph of the surface of a specimen at a magnification of 400 times. The section shown is of a longitudinal section perpendicular to the roller surface of the starting billet. As can be seen clearly in FIG. 2, the micro-structure of the starting material is composed of grains 20 of relatively large size, which are elongated in the direction (A) of, and as a result of, a previous rolling operation.

The recrystallization temperature $Tr_1$ of the starting material is determined as follows. Eight specimens each approximately a centimeter cube, are taken from the starting material and annealed for one hour at temperatures intervals of 10° C. in the range 310° C. to 380° C. (i.e. the first sample at 310° C, the second at 320° C., the third at 330° C. etc). After annealing the samples are quenched in water, and a longitudinal section perpendicular to the rolled surface is polished and etched in 5% alcoholic ferric chloride for metallographic examination.

Figure 3A:
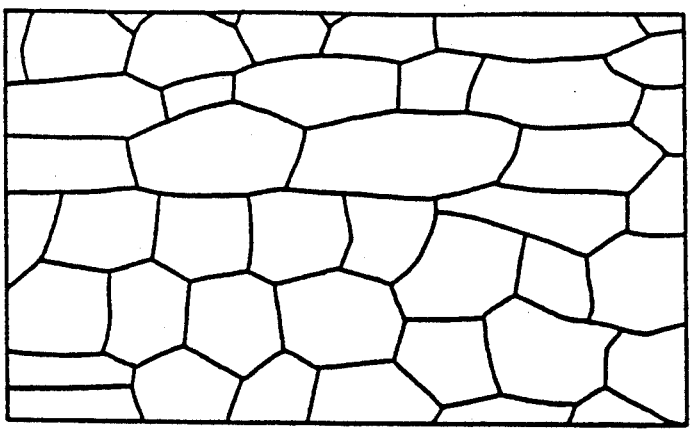
Figure 3B:
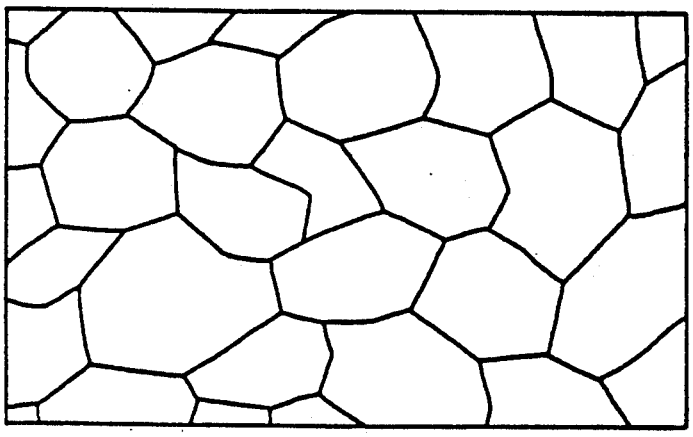
Figure 3C:
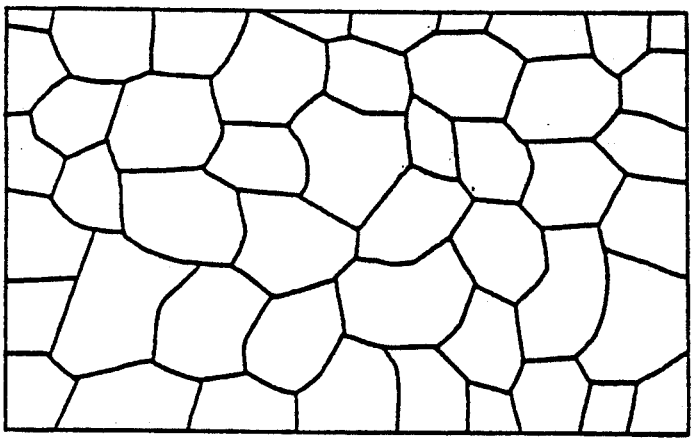

FIGS. 3*a*, 3*b* and 3*c* show the micro-structure of the cross sections of three specimens thus prepared. FIG. 3*a* shows the micro-structure of the material annealed at a temperature of 280° C. which is just too low, the structure has recovered but not recrystallized. FIG. 3*b* shows the micro-structure of the material annealed at a temperature of 360° C. or above, which is too high, the structure has recrystallized but the heat treatment has resulted in grain growth. FIG. 3*c* shows the micro-structure of the material annealed at the correct temperature of 330° C.

The recrystallization temperature $Tr_1$ for this starting material is thus determined as 330° C. The starting billet is then annealed for a period of one hour at a temperature of 330° C.+10° C.±5° C. in an aircirculating furnace, the time period commencing when the billet reaches the specified temperature band. The billet is then water quenched, and cold rolled to give 75% reduction in thickness to 15.88 mm±0.15 mm.

Figure 4A:
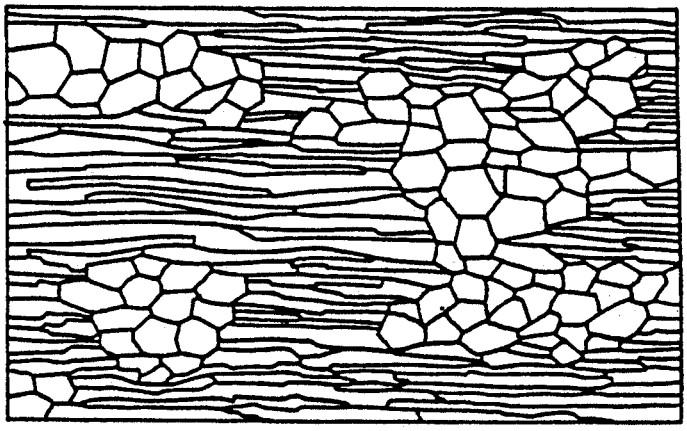
Figure 4B:
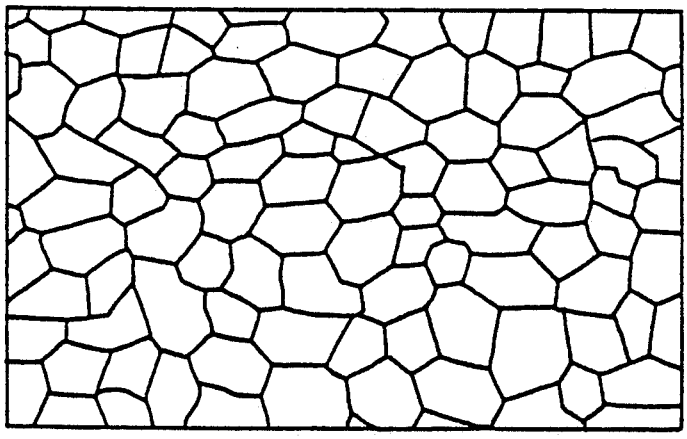
Figure 4C:
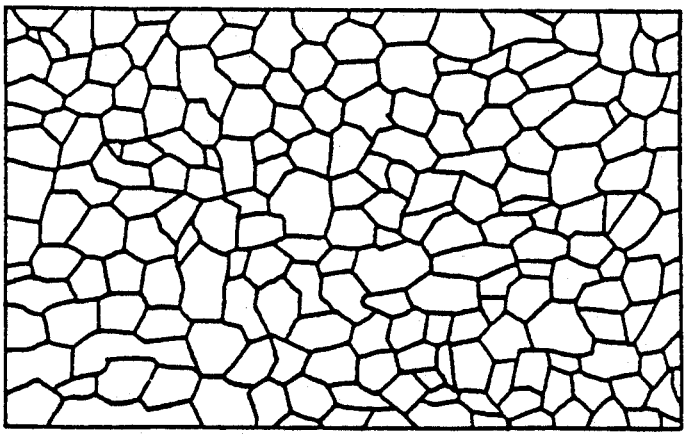

The recrystallization temperature $Tr_2$ of the cold-rolled material is then determined by the same method as for the recrystallization temperature $Tr_1$ of the starting material. FIGS. 4*a*, 4*b* and 4*c* show the micro-structure of the cross sections of three specimens prepared as previously. FIG. 4*a* shows the micro-structure of the material annealed at a temperature of 260° C. which is just too low the structure has recovered but not recrystallized. FIG. 4*b* shows the micro-structure of the material annealed at a temperature of 340° C. or above, which is too high, the structure has recrystallized but the heat treatment has resulted in grain growth. FIG. 4*c* shows the micro-structure of the material annealed at the correct temperature $Tr_2$ of 290° C. As can be seen, the general form of the structure is similar to that of FIG. 3*c*, but the grain size is now much finer. The plate is now annealed in an air circulating furnace for one hour at a temperature $Tr_2$+10° C.±5° C. and water quenched.

The plate is then further cold rolled to effect a further reduction in thickness of the order of 50%, the recrystallization temperature $Tr_3$ of the further cold worked material is determined as before for $Tr_1$ and $Tr_2$, and the plate is annealed for 1 hour at temperature $Tr_3$+10° C.±5° C., in the air circulating furnace followed by water quenching. A further reduction in grain size is thus effected, to provide a substantially isotropic material having a grain size of 0.015 (15 microns) or less, and of the general form shown in FIG. 4*c*. In other cases this point could be reached by a different number of repetitions of the cold working, annealing and quenching cycle as appropriate, and/or by grain refining through elemental additions at the casting stage.

The resulting plate material is then cut into pieces of suitable size and shape, and each piece is then formed into a conical liner blank by a suitable cold working process such as shear forming. The recrystallization temperature $Tr_4$ of the cold shear formed blanks is then determined by the same method as for $Tr_1$, and the blanks are annealed for one hour at temperature $Tr_4+10°$ C.±5° C. in the air circulating furnace, followed by water quenching. The grain size of the resulting blanks is 15 microns or less, the material being fine grain and substantially isotropic and of the general form shown in FIG. 4c. The liner blanks are then machined if desired, to produce finished liners to the final toleranced dimensions required, and having a particularly fine grain size of 15 microns or less, and an integral, substantially void-free homogeneous structure.

Tests carried out on liners produced by the method described have shown that shaped charges employing liners in accordance with the invention are capable, as compared with similar shaped charges employing copper liners of conventional manufacture, of more consistent performance, and up to 15% greater penetration into a target of RHA.

The term "grain size" as used herein means the average grain diameter as determined using ASTM Designation: E112 Intercept (or Heyn) procedure.

Modifications to the invention as specifically described will be apparent to those skilled in the art, and are to be considered as falling within the scope of the invention. For example, other methods of producing a fine-grain liner will possibly be suitable, such as by deposition from a plasma spray fed with appropriately fine particles, on to a suitable former, followed by light machining if necessary.

I claim:

1. A liner for a shaped charge consisting of a solid, substantially non-porous metallic material with isotropic properties having a crystal structure of substantially equi-axed grains with a grain size of 25 microns or less.

2. The liner of claim 1 wherein said grain size is 22 microns or less.

3. The liner of claim 2 wherein said grain size ranges from 10 to 15 microns.

4. The liner of claim 1 wherein said metallic material is copper.

5. The liner of claim 1 wherein said metallic material is selected from the group consisting of uranium, tantalum and an alloy which exhibits superplastic properties and has a density greater than about 5 gm/cm$^3$.

6. The liner of claim 1 wherein said metallic material includes an elemental addition which serves to refine the grain size.

7. The liner of claim 6 wherein said metallic material is selected from the group consisting of a copper-1% chromium alloy and a uranium-5% molybdenum alloy.

8. The liner of claim 1 wherein said metallic material is substantially isotropic.

9. A shaped charge comprising a liner in accordance with claim 1 and an explosive mass associated with said liner.

* * * * *